US012604943B2

(12) United States Patent
Stanley et al.

(10) Patent No.: US 12,604,943 B2
(45) **Date of Patent: *Apr. 21, 2026**

(54) GROUNDING FOOTWEAR WITH A BLADE PORTION

(71) Applicant: N-ION SPORTS TECHNOLOGY LIMITED, Bootle (GB)

(72) Inventors: Adam Stanley, Liverpool (GB); Stephen Walsh, Liverpool (GB)

(73) Assignee: N-ION SPORTS TECHNOLOGY LIMITED, Bootle (GB)

( * ) Notice: Subject to any disclaimer, the term of this patent is extended or adjusted under 35 U.S.C. 154(b) by 0 days.

This patent is subject to a terminal disclaimer.

(21) Appl. No.: 17/588,320

(22) Filed: Jan. 30, 2022

(65) Prior Publication Data

US 2022/0151335 A1 May 19, 2022

Related U.S. Application Data

(63) Continuation-in-part of application No. 16/301,973, filed on Nov. 15, 2018, now Pat. No. 11,246,372.

(51) Int. Cl.

| | |
|---|---|
| ***A43B 7/36*** | (2006.01) |
| ***A43B 17/00*** | (2006.01) |
| ***A43C 15/16*** | (2006.01) |

(52) U.S. Cl.

CPC ..... *A43B 7/36* (2013.01); *A43B 17/006* (2013.01); *A43C 15/161* (2013.01)

(58) Field of Classification Search

CPC ..... A43B 7/36; A43B 13/14; A43B 13/26; A43B 1/08; A43B 13/30; A43B 5/02; A43B 5/001; A43C 15/16; A43C 15/161; A43C 15/167

USPC ..... 361/223, 224

See application file for complete search history.

(56) References Cited

U.S. PATENT DOCUMENTS

| | | | | |
|---|---|---|---|---|
| 1,043,361 A | | 11/1912 | Roemer | |
| 2,023,346 A | * | 12/1935 | Temple | A43B 7/36 361/224 |
| 2,273,563 A | * | 2/1942 | Delamere | A43B 7/36 607/144 |
| 2,650,327 A | * | 8/1953 | Legge | A43B 7/36 439/37 |
| 2,712,098 A | * | 6/1955 | Legge | A43B 7/36 361/220 |
| 2,712,099 A | * | 6/1955 | Legge | A43B 7/36 361/224 |

(Continued)

FOREIGN PATENT DOCUMENTS

| | | |
|---|---|---|
| CN | 203252025 U | 10/2013 |
| CN | 204317653 U | 5/2015 |

(Continued)

*Primary Examiner* — Heather Mangine

(74) *Attorney, Agent, or Firm* — Craft Chu PLLC; Andrew W. Chu

(57) ABSTRACT

The article of footwear for grounding the human body to earth includes an upper portion; a sole having an outer sole face distal from a user and an inner sole face proximate to the user; one or more electrically conductive portions which extend through the sole from the outer sole face to the inner sole face; and an electrically conductive layer which extends over a portion of the inner sole face and being configured to make conductive contact with the foot of the human body. The sole includes a blade portion.

12 Claims, 8 Drawing Sheets

(56) References Cited

U.S. PATENT DOCUMENTS 2,857,556 A * 10/1958 Price ..... A43B 7/36 361/224
2,904,724 A * 9/1959 Mendoza ..... A43B 7/36 607/144
3,133,364 A * 5/1964 Wormelle, Jr. ..... A43C 15/161 D2/962
3,274,442 A * 9/1966 Peel ..... A43B 7/36 361/224
3,293,494 A * 12/1966 Fischer ..... A43B 7/36 36/4
3,302,227 A * 2/1967 Bente ..... A43C 13/04 156/303.1
3,383,559 A * 5/1968 Oesterheld ..... A43B 7/36 361/224
3,466,763 A * 9/1969 Levin ..... A43B 5/02 36/134
3,544,841 A * 12/1970 Peel ..... A43B 7/36 361/224
3,587,181 A * 6/1971 Bernier et al. ..... A43C 15/161 264/277
4,004,356 A * 1/1977 Green ..... A43C 15/161 36/134
4,466,205 A * 8/1984 Corbari ..... A43C 15/161 36/62
4,587,748 A * 5/1986 Collins ..... A43B 5/001 36/134
4,644,672 A * 2/1987 Dassler ..... A43C 15/161 36/62
4,712,318 A * 12/1987 Greiner ..... A43C 15/161 36/134
4,727,452 A * 2/1988 Brownlee ..... A43B 7/36 361/220
4,812,948 A * 3/1989 Bird ..... A43B 7/36 361/223
5,154,886 A * 10/1992 Franey ..... C08K 3/08 428/922
5,293,701 A * 3/1994 Sullivan ..... A43C 15/164 36/114
5,386,651 A * 2/1995 Okamoto ..... A43C 15/16 36/134
5,576,924 A * 11/1996 Hee ..... H05F 3/02 361/223
5,617,653 A * 4/1997 Walker ..... A43C 15/161 36/134
5,653,047 A * 8/1997 Franey ..... A43B 7/36 361/224
5,832,636 A * 11/1998 Lyden ..... A43B 13/26 36/134
5,987,784 A * 11/1999 Bignell ..... B29D 35/122 36/134
6,219,942 B1 * 4/2001 Fini ..... A43B 7/28 36/154
6,421,222 B1 * 7/2002 Maritz ..... A43B 13/12 361/224
6,549,391 B1 * 4/2003 Bisson ..... A43B 7/36 361/224
7,471,497 B1 * 12/2008 Knight, Sr. ..... A43B 7/36 361/224
8,069,584 B2 * 12/2011 Wang ..... A43B 7/36 36/43
10,433,614 B1 * 10/2019 Dickerman ..... A43B 13/04
2002/0112375 A1 * 8/2002 Elsey ..... A43B 5/00 36/25 R
2002/0178619 A1 * 12/2002 Schaudt ..... A43B 5/02 36/67 D
2002/0181183 A1 * 12/2002 Lee ..... A43B 7/36 361/223
2003/0230007 A1 * 12/2003 Walton ..... A43B 13/36 36/15
2004/0159020 A1 * 8/2004 Briant ..... A43C 15/168 36/134
2007/0000155 A1 * 1/2007 Laufer ..... A43B 7/36 36/136
2007/0079527 A1 * 4/2007 Daniels ..... A43B 13/26 427/180
2008/0289217 A1 * 11/2008 Horvath ..... A43B 7/36 36/25 R
2010/0031537 A1 * 2/2010 Geisler ..... A43B 7/36 12/146 B
2010/0229427 A1 * 9/2010 Campbell ..... A43C 15/168 36/62
2011/0192054 A1 * 8/2011 Wojnar ..... A43C 15/061 36/103
2012/0159816 A1 * 6/2012 Wu ..... A43B 13/26 36/134
2013/0333247 A1 * 12/2013 Grott ..... A43B 13/122 36/114
2013/0340295 A1 * 12/2013 Adami ..... A43B 13/04 12/146 B
2014/0345164 A1 * 11/2014 Campbell ..... A43C 15/162 36/103
2015/0282566 A1 * 10/2015 Gruhn ..... B29D 35/142 264/261
2015/0305447 A1 * 10/2015 Cavaliere ..... A43B 5/02 36/66
2015/0366289 A1 * 12/2015 Rustam ..... A43B 13/122 264/46.4
2016/0021981 A1 * 1/2016 Sanchez ..... A43C 15/02 36/114
2016/0114546 A1 * 4/2016 Yang ..... B29D 35/122 12/146 B
2016/0324258 A1 * 11/2016 Harml ..... A43B 5/002
2018/0051171 A1 * 2/2018 Prissok ..... C08K 3/04
2018/0070674 A1 * 3/2018 Schiller ..... A43B 5/185
2018/0117867 A1 * 5/2018 Yang ..... A43B 13/26
2018/0125169 A1 * 5/2018 Hirai ..... A43C 15/162
2019/0150555 A1 * 5/2019 Stanley ..... A43B 13/14
2022/0151335 A1 * 5/2022 Stanley ..... A43B 7/36

FOREIGN PATENT DOCUMENTS

DE 21 47 904 A1 3/1973
WO 91/00031 A1 1/1991
WO 01/87103 A1 11/2001
WO 02/26071 A1 4/2002

* cited by examiner

GROUNDING FOOTWEAR WITH A BLADE PORTION

CROSS-REFERENCE TO RELATED APPLICATIONS

The present application claims priority under 35 U.S.C. Section 120 from U.S. patent application Ser. No. 16/301,973, filed on 15 Nov. 2018, entitled "GROUNDING FOOTWEAR". See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

This invention relates to grounding footwear. In particular, this invention relates to footwear that can be used to discharge extraneous static electricity and charges from an individual during sports and leisure activities.

2. Description of Related Art Including Information Disclosed Under 37 CFR 1.97 and 37 CFR 1.98

Interest in the practice of "grounding" or "earthing" the human body has grown in recent years. In the simplest form, the practice involves being in direct contact with the ground or earth by walking, sitting or lying (the terms "grounding" and "earthing" are interchangeable, and for brevity hereinafter will be referred to simply as "grounding" or the "ground"). When grounded in this manner, any extraneous static electricity, positive ions and other electromagnetic fields and charges that are present in the human body can be naturally dissipated to the ground. Grounding the human body on a regular basis allows it to dissipate all of the extraneous static electricity and charges that are accumulated whilst wearing manmade soles, and by living and working at elevated levels to the ground and allows an individual to harness or receive the negative ions that are present in organic materials, such as rain, trees, plants and minerals from the ground. Various scientific studies have pointed to a positive effect on the human psyche, and an improved general sense of wellbeing by the practice of grounding, as detailed below.

Researchers have found that sleeping on an electrically grounded conductive mat produced quantifiable changes in cortisol levels (Ghaly, M., Teplitz, D., "The Biologic Effects of Grounding the Human Body During Sleep as Measured by Cortisol Levels and subjective Reporting of Sleep, Pain and Stress", The Journal of Alternative and Complementary Medicine, Vol. 10, No. 5, 2004, pp. 767-776). This was found to improve sleep and reduce pain and stress in nearly all subjects. The practice of grounding has also been found to improve the symptoms of Seasonal Affective Disorder (SAD) and other types of depression (Terman, M., Terman, J. S., "Controlled Trial of Naturalistic Dawn Simulation and Negative Air Ionization for Seasonal Affective Disorder", American Journal of Psychiatry, Vol. 163, 2006, pp. 2126-2133).

In the area of sports science, the use of grounding (either through being in direct contact with the ground by walking, sitting or lying, or through the use of electrically grounded conductive mats or pads) has allowed sportsmen and women to recover more quickly after exercise, and to reduce pain and inflammation and have more energy. Studies have revealed that grounding to harness the negatively charged electrons and ions carried in the earth also reduces lactic acid build up that occurs during and after exercise (Brown, D., Chevalier, G., Hill, M., "Pilot Study on the Effect of Grounding on Delayed-Onset Muscle Soreness", The Journal of Alternative and Complementary Medicine, Vol. 16, No. 3, 2010, pp. 265-273).

In modern sports stadia, an athlete, such as a professional football player, is bombarded by a multitude of unseen charges, fields and frequencies which all stem from developments in terms of telecommunications and computerisation. For example, infrared radiation, wireless technology (WiFi), mobile telecommunications signals and networks, such 3G and 4G, and countless other digital and cellular signals received and transmitted by modern smartphones and electronic devices. In addition, the manmade non-conductive footwear of the modern athlete disconnects them from remaining grounded during this electromagnetic frequency (EMF) radiation bombardment, which can lead to a large inflammation build up during gameplay, and which could then either cause or compound existing injuries and possible chronic conditions in the athlete.

Therefore, there is the need for a product that has the ability to not only connect the athlete to the ground, enabling his/her body's natural healing and recovery system to occur during active play, but which can also enhance the body's performance by aiding in the recovery process.

It is an object of the present invention to provide footwear that can be used to discharge extraneous static electricity and charges from an individual during sports and leisure activities. Such footwear alleviates the drawbacks associated with known non-conductive sports and leisure footwear, which provide no grounding effect. The present invention provides footwear that can be worn to give an improved sense of wellbeing. It is an object of the present invention to provide sports and leisure footwear and its method of manufacture which does not affect the mechanical and aesthetic properties of the footwear, nor does it significantly increase weight of the footwear. Use of the present invention helps to eradicate the effects of extraneous static electricity, positive ions and other electromagnetic fields and charges that are accumulated in the human body by naturally dissipating them to the ground to give an improved sports and/or athletic performance. Use of the present invention helps to aid the recovery and healing of the human body's natural equilibrium, to promote a balance in blood cell congestion and reduce inflammation. Use of the present invention is particularly beneficial for sportspersons who are prone to injury or who suffer from reoccurring chronic conditions.

BRIEF SUMMARY OF THE INVENTION

The present invention is described herein and in the claims.

According to the present invention there is provided an article of footwear for grounding the human body to earth, comprising:

- an upper portion that covers the foot of the user;
- a sole having an outer sole face distal from a user and an inner sole face proximate to the user;
- an electrically conductive portion which extends through the sole from the outer sole face to the inner sole face; and
- an electrically conductive layer which extends over a portion of the inner sole face and being configured to make conductive contact with the foot of the human body.

An advantage of the present invention is that it can be used to discharge extraneous static electricity and charges from an individual during sports and leisure activities Preferably, the sole is planar.

Further preferably, the outer sole face and the inner sole face are planar and parallel to each other.

In use, the sole may be rigid or semi-rigid and is formed from a resin, rubberized and/or hard plastics material.

Preferably, the sole can be comprised of a stud receiving portion [and] or a blade portion or both. The blade portion extends from the outer sole face. The blade portion can be integrally molded to the outer sole face as raised projections. The electrically conductive portion can extend through the sole from the outer sole face to the inner sole face. For the stud receiving portion, the electrically conductive portion with a shaft can extend through the stud receiving portion. For the blade portion, the electrically conductive portion with a conductive material end extends through the blade portion. For an embodiment with a stud receiving portion through a surrounding projection of the sole around the stud receiving portion, the electrically conductive portion with a shaft can extend through the stud receiving portion and the surrounding projection around the stud receiving portion.

Further preferably, each of the stud receiving portions being formed from a separate suitable metal or rigid plastics material and can be molded in the sole to receive the thread of the electrically conductive portion with a threaded screw stud.

In use, each threaded screw stud may have a body portion configured generally as a truncated cone or truncated pyramid and a shaft disposed through the body portion having at one end a thread which is dimensioned to be received in the stud receiving portion and an exposed ground contacting portion at the other end of the shaft.

Preferably, the shaft being formed from an electrically conductive material.

Further preferably, the electrically conductive material forming the shaft is selected from the group consisting, but not limited to, any one of the following: copper, silver, silver plated or coated steel, carbon fiber or an alloy or mixtures thereof.

In use, the body portion may comprise projections for engagement with a complementary shaped tool for fixture and/or replacement in the sole.

Preferably, the body portion comprises an annular shoulder which meets with the outer face of the stud receiving portion when fully screwed in.

Further preferably, disposed at the threaded end of each of the threaded screw studs is a low-profile lug or push-fit type connector, the lug or connector projecting through a slit or opening formed in the inner sole face when fully screwed in.

In use, the lug or connector may be connected to one end of an exposed conductive wire, the electrical connection of the wire to the lug or connector being via a physical spade connection and/or a crimp connection and/or a soldered connection.

Further preferably, disposed inside the threaded end of each of the threaded screw studs is a blind hole.

Preferably, the other end of the exposed conductive wire forms a loop connected to the lug or connector of a neighboring threaded screw stud.

Further preferably, the conductive wire loop is positioned in a generally flat configuration adjacent to the inner sole face.

In use, the conductive wire loop may be positioned in a generally flat configuration contiguous with the inner sole face.

Preferably, a plurality of conductive wire loops is positioned adjacent to the inner sole face.

Further preferably, the number of conductive wire loops is three and the number of threaded screw studs is six.

In use, the conductive wire loop connected between neighboring pairs of threaded screw studs may be C- or U-shaped.

Preferably, the conductive wire loop connected between neighboring pairs of threaded screw studs is formed having a convoluted path.

Further preferably, the conductive wire loop being formed from copper, silver or alloys or mixtures thereof.

In use, the one or more threaded screw studs may be provided along the length of the outer sole face projecting therefrom in pairs, with a pair of threaded screw studs located generally around a heel portion, a pair of threaded screw studs located generally around a instep portion, and a pair of threaded screw studs located generally around an instep portion of the sole.

Preferably, the electrically conductive layer comprises a layer of conductive tape or fabric.

Further preferably, the layer of conductive tape or fabric is a copper or silver-based tape or fabric material.

In use, the layer of conductive tape may be embossed copper tape, with an acrylic pressure sensitive adhesive and liner.

Preferably, the embossed copper tape adheres the conductive wire loop in place.

Further preferably, the footwear further comprising an insole on top of the layer of conductive tape proximate to the user, the insole providing a cushioning layer formed from a woven fabric material that includes a conductive yarn selected from the group consisting, but not limited to, any one of the following: strands of copper, silver, carbon fiber and combinations thereof.

In use, the insole may be anatomically shaped to the foot of the user when in use.

Preferably, an electrically conductive portion, being disposed in blade portions as integrally-molded blades or raised protections, is a portion or cylinder of conductive material which extends from the outermost part of the blade portion to the inner sole face.

Further preferably, the portions or cylinders of conductive material are held in place in an aperture which extends from the outermost part of the blade portion to the inner sole face via an interference fit or being adhered in place by the use of a suitable adhesive.

In use, the portions or cylinders of conductive material may be selected from the group consisting, but not limited to, any one of the following: copper, silver, silver plated or coated steel, carbon fiber or an alloy or mixtures thereof.

Preferably, the portions or cylinders of conductive material are formed integrally with the sole via ion beam mixing.

Further preferably, the article of footwear is selected from the group consisting, but not limited to, any one of the following: football shoes, tennis shoes, golf shoes, rugby boots, American football boots, hockey shoes, running spikes.

In use, the upper portion is formed from a conductive fabric material.

Preferably, the footwear further comprises a soluble coating being applied to the upper portion and the sole, which also incorporates a conductive compound.

Also, according to the present invention, there is provided method of manufacturing an article of footwear comprising an upper portion configured to cover a wearer's foot, and a sole having an outer sole face and an inner sole face, the method comprising the steps of:

- inserting a plurality of electrically conductive portions completely through the sole from the outer sole face to the inner sole face;
- securing the plurality of electrically conductive portions in place and electrically connecting the portions using exposed wire; and
- placing and adhering an electrically conductive layer on top of the exposed wire; and
- optionally placing a conductive insole over the electrically conductive layer.

It is believed that grounding footwear and its method of manufacture in accordance with the present invention at least addresses the problems outlined above.

It will be obvious to those skilled in the art that variations of the present invention are possible, and it is intended that the present invention may be used other than as specifically described herein.

BRIEF DESCRIPTION OF THE SEVERAL VIEWS OF THE DRAWINGS

The present invention will now be described by way of example only, and with reference to the accompanying drawings.

DETAILED DESCRIPTION OF THE INVENTION

The present invention has adopted the approach of utilizing footwear to discharge extraneous static electricity and charges from an individual during sports and leisure activities. Advantageously, the present invention provides footwear that can be worn to give an improved sense of well-being. Further advantageously, the present invention provides sports and leisure footwear and its method of manufacture which does not affect the mechanical and aesthetic properties of the footwear, nor does it significantly increase weight of the footwear. Use of the present invention helps to eradicate the effects of extraneous static electricity, positive ions and other electromagnetic fields and charges that are accumulated in the human body by naturally dissipating them to the ground to give an improved sports and/or athletic performance. Use of the present invention helps to aid the recovery and healing of the human body's natural equilibrium, to promote a balance in blood cell congestion and reduce inflammation. Use of the present invention is particularly beneficial for sportspersons who are prone to injury or who suffer from reoccurring chronic conditions.

Figure 1:
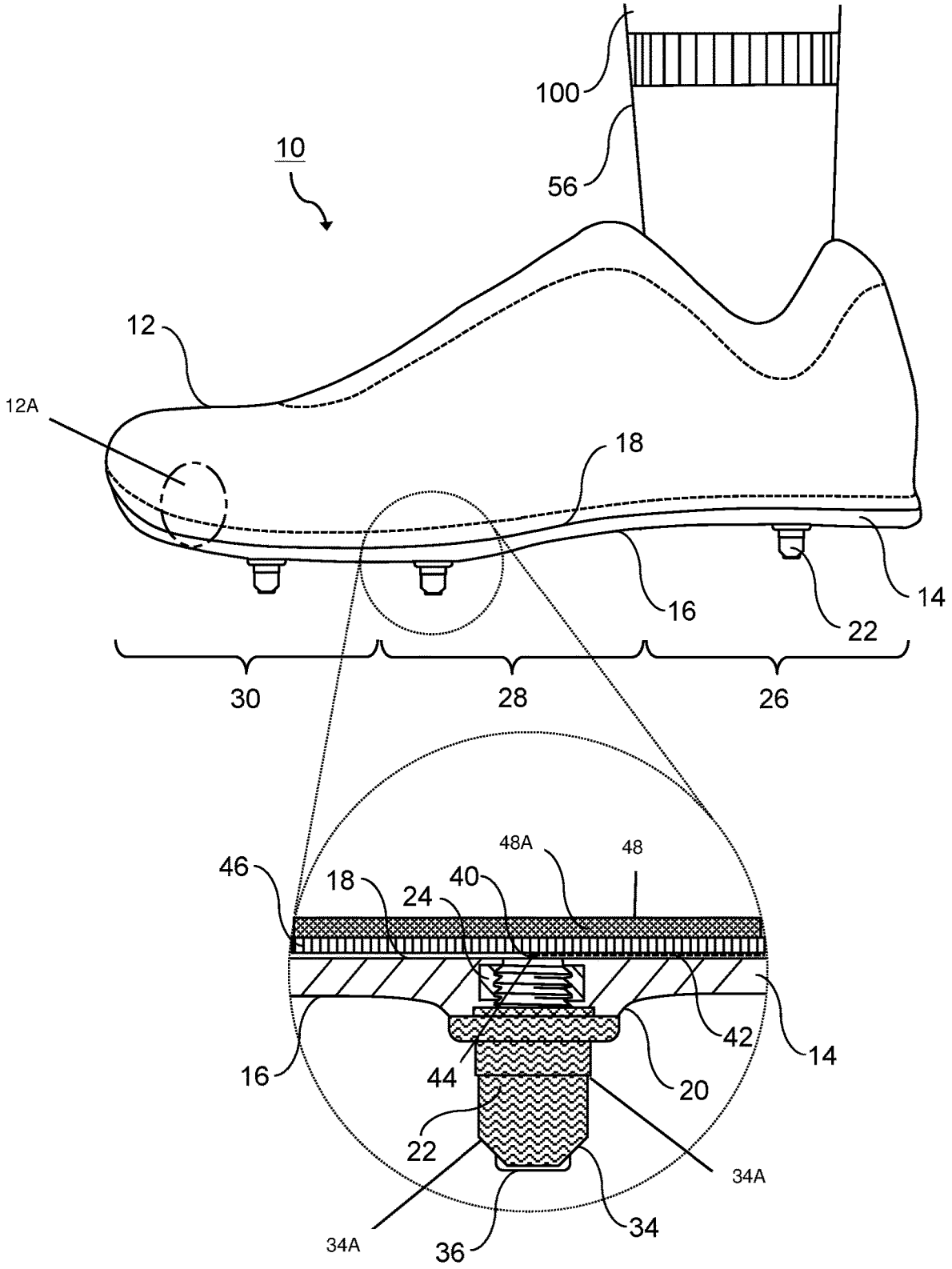
FIG. 1 is a side schematic view of the footwear in accordance with the present invention and which also shows a cross-sectional view from the side of the electrical grounding connection between the underside of studded sole to the user.
Figure 2:
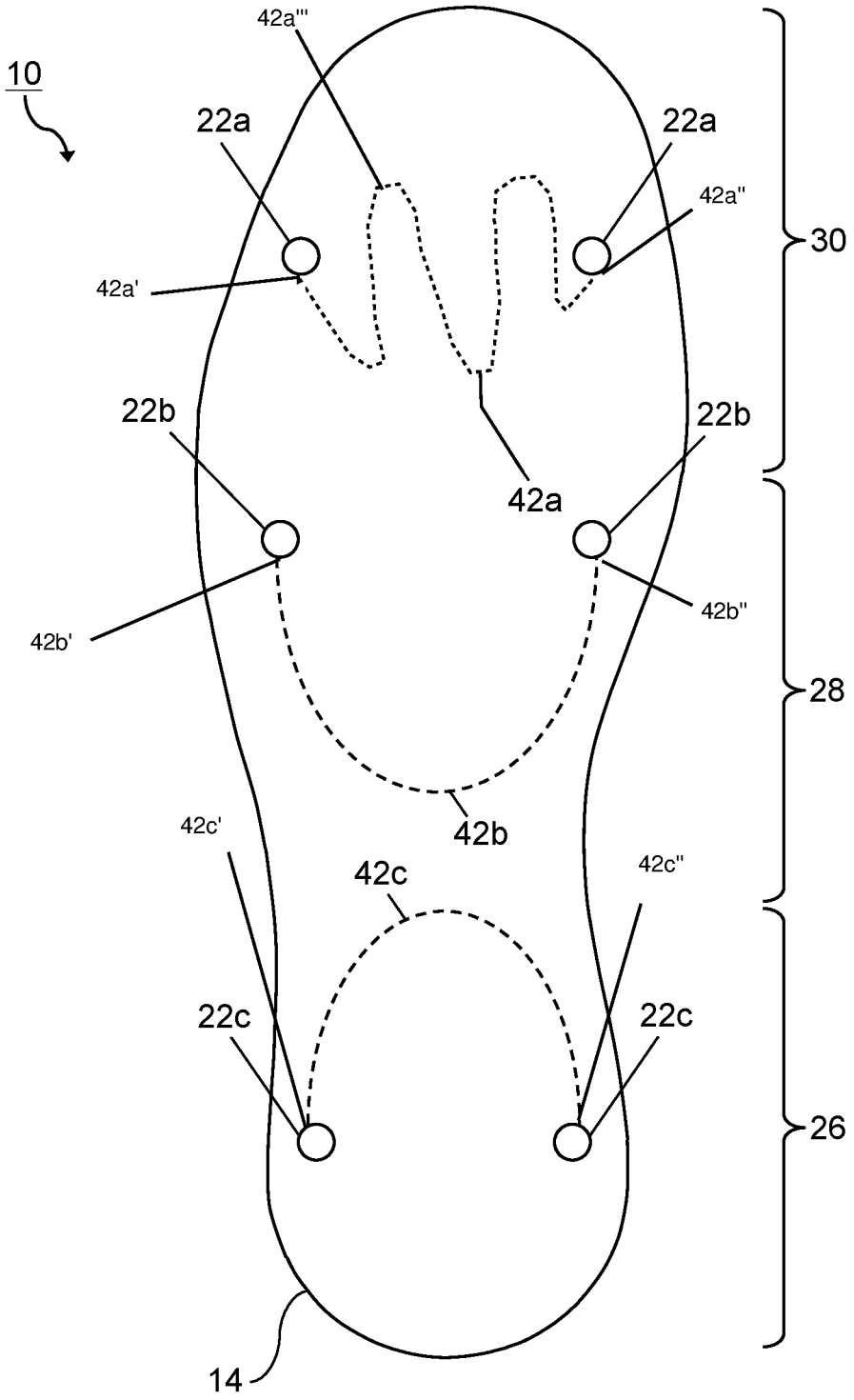
FIG. 2 shows a cross-sectional plan view from above of the top of the inwardly facing sole face of the footwear of FIG. 1.
Figure 3:
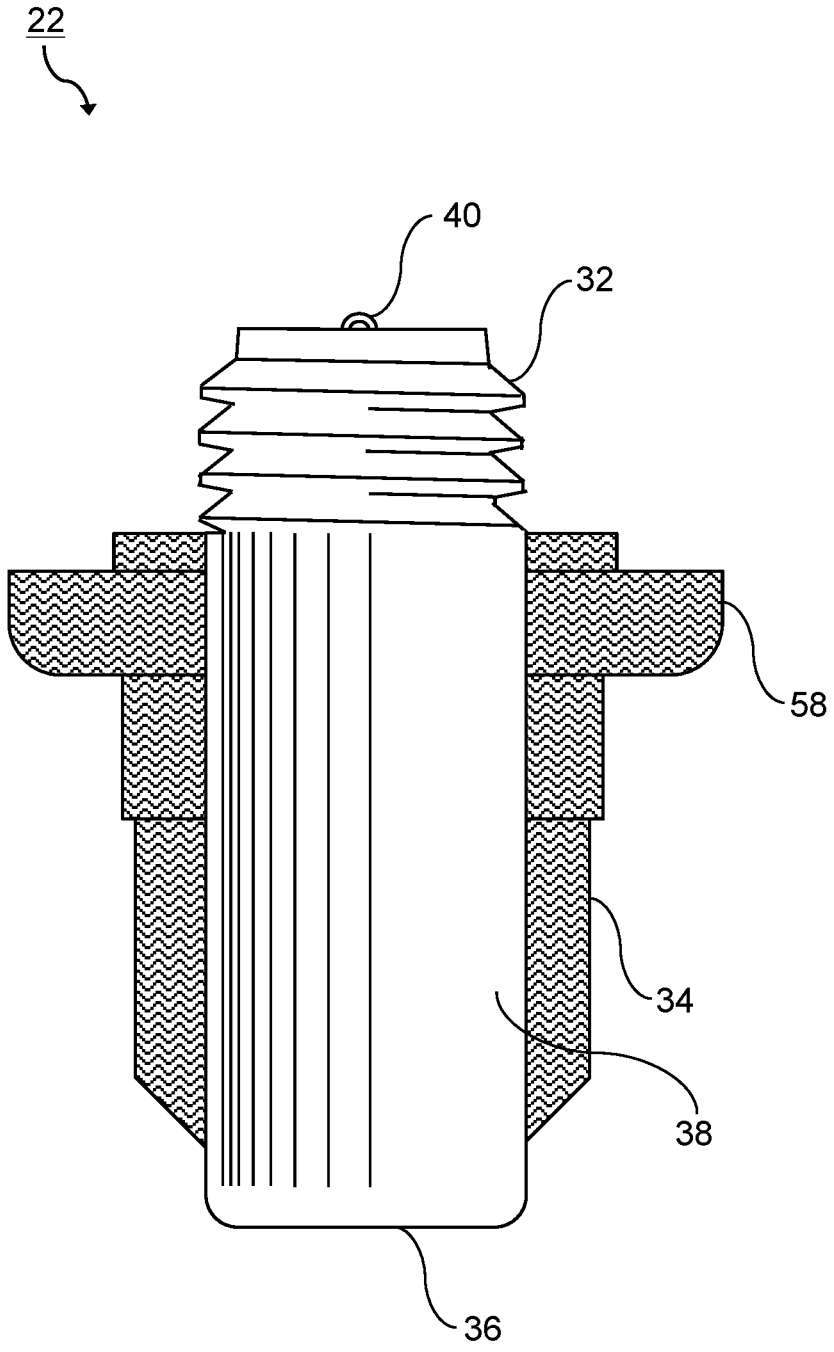
FIG. 3 illustrates a cross-sectional view from the side of a screw stud for use with the footwear of FIG. 1.

Referring now to the drawings, electrically grounded footwear or shoe 10 according to the present invention is illustrated in FIGS. 1 to 3. Specifically, the shoe 10 in this exemplary embodiment is described in relation to a screw studded football or rugby shoe. The shoe 10 has an upper 12 which is bonded to a sole 14. The sole 14 consists of a generally flat portion formed from a rigid or semi-rigid material, such as, for example, a molded resin, rubberized or hard plastics material.

As shown in FIG. 1, the sole 14 is formed having two opposing faces which are generally planar and parallel to each other, having an outwardly facing sole face 16 at its underside and an opposite inwardly facing sole face 18 which is proximate to the user 100 when in use.

Figure 7:
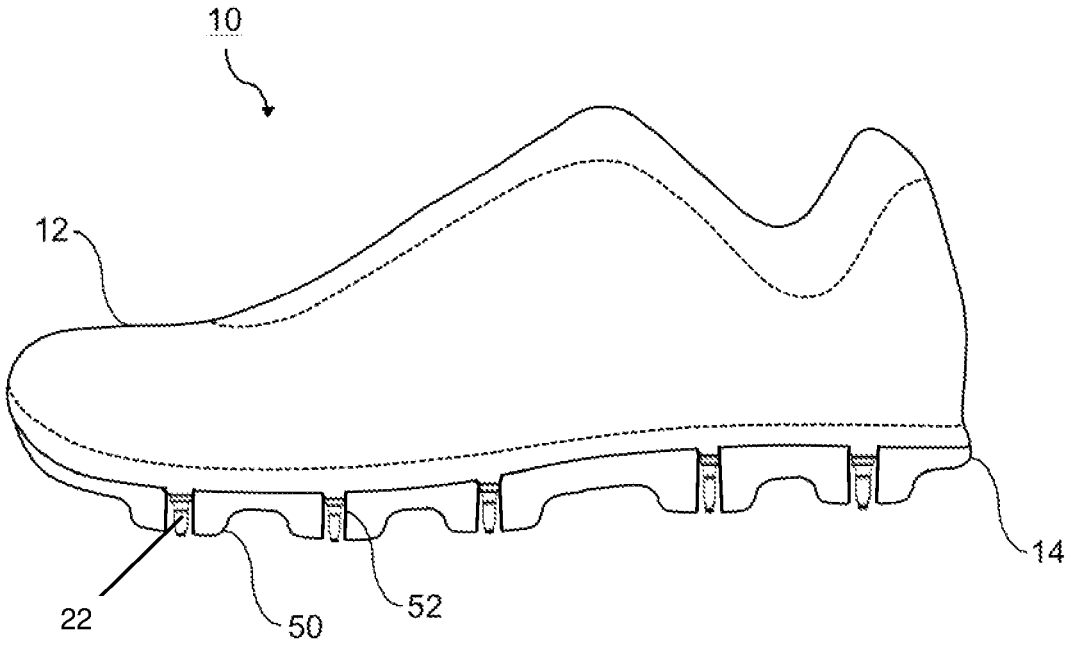
FIG. 7 is a side schematic view of an embodiment of the present invention having a stud receiving portion through a surrounding projection of the sole around the stud receiving portion, the electrically conductive portion with a shaft extending through the stud receiving portion and the surrounding projection around the stud receiving portion.
Figure 8:
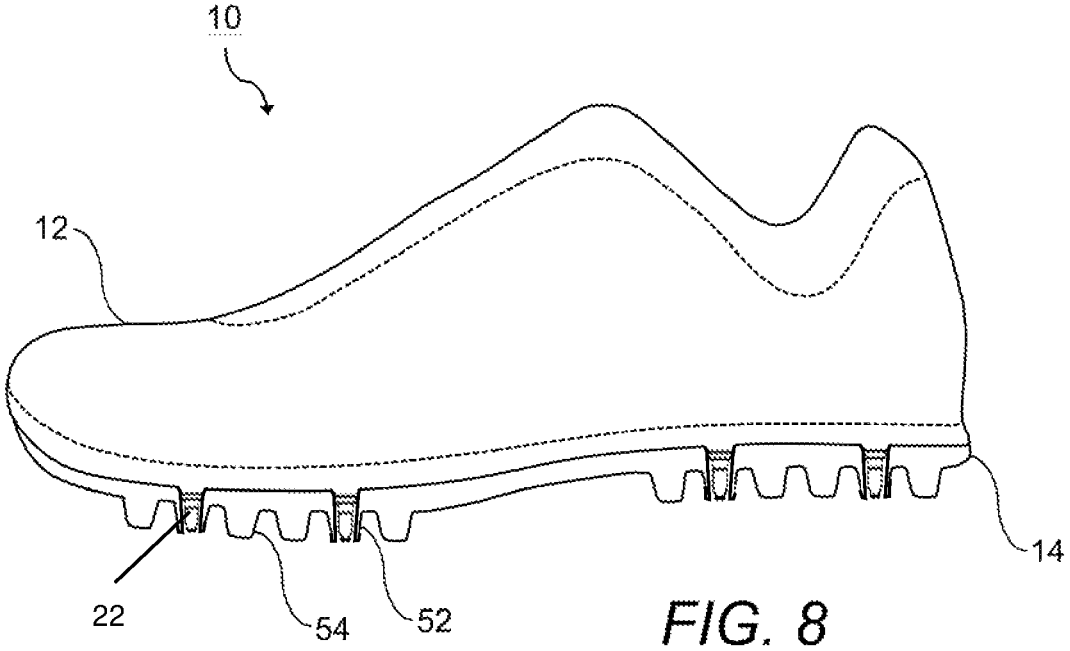
FIG. 8 shows a side schematic view of another embodiment of the present invention having the stud receiving portion through a surrounding projection of the sole around the stud receiving portion, the electrically conductive portion with a shaft extending through the stud receiving portion and the surrounding projection around the stud receiving portion.
Figure 9:
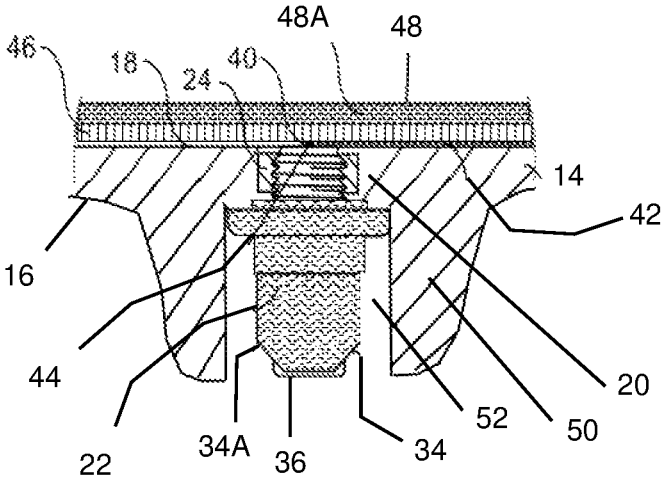
FIG. 9 is an isolated cross-sectional view of the embodiment of the present invention with the sole having the stud receiving portion through a surrounding projection of the sole around the stud receiving portion, the electrically conductive portion with a shaft extending through the stud receiving portion and the surrounding projection around the stud receiving portion.

Depending upon the sport or leisure activity for which the shoe 10 is intended to be used, the outer sole face 16 may include a blade portion, which can be integrally molded to the sole. The blade portion can be detents, raised protections, blades, protrusions, or other features for providing grip (as shown for example in the embodiments of FIGS. 4, and 5). The stud receiving portion through a surrounding projection of the sole around the stud receiving portion is shown in FIGS. 7-9. The electrically conductive portion with a shaft extends through the stud receiving portion and the surrounding projection around the stud receiving portion. The sole 14 includes one or more stud receiving portions 20 capable of receiving one or more complementary threaded screw studs 22.

To ensure a strong mechanical securement of the screw studs 22 to the outer sole face 16, a threaded aperture or threaded retaining insert 24 is molded in the sole 14 to receive the thread 32 at one end of the screw stud 22, as best shown in FIG. 3. The threaded aperture or threaded retaining insert 24 can be integrally molded with the sole 14 or formed from a separate suitable metal or rigid plastic material and inserted in the sole 14.

The plurality of screw studs 22 are provided along the length of the outer sole face 16 extending generally in pairs, at least through the heel portion 26, instep portion 28 and toe portion 30, as shown in FIGS. 1 and 2. The skilled person will appreciate that other configurations, including additional screw studs 22, can be positioned throughout the sole 14 and this is in no way intended to be limiting.

As best shown in FIG. 3, each of the screw studs 22 is configured as a truncated cone or truncated pyramid and include at one end a threaded portion 32 which is dimensioned to be received in the complementary threaded aperture or retaining insert 24 in the sole 14. The threaded portion 32 is fabricated from an electrically conductive material, such as copper, silver or silver plated or coated steel, or an alloy or mixtures thereof, and extends through the plastic body or body portion 34 of the stud 22 as a shaft 38, which is completely exposed at the opposite end 36 to the thread 32. In the exemplary embodiment of the invention shown in FIGS. 1 to 3, the body 34 of the screw stud is trilobulor, cruxiform or cone-shaped with projections 34A for engagement with a complementary shaped tool (not shown) for fixture and/or replacement. The body portion 34 also includes an annular shoulder 58 which meets with the outer face of the stud receiving portion 20 when fully screwed in. In a preferred embodiment, the threaded portion 32 and retaining inset 24 are provided having M4, M5 or M6 ISO metric screw threads.

The construction of the screw stud 22 can be via any suitable form of fabrication, i.e., the elongate metal bar or shaft 38 forming the threaded portion 32 at one end and the ground contacting base 36 at the other end, can machined, pressed, cast or forged from a suitable conducting metal. The plastic outer stud body 34 is then molded around the shaft, as best shown in FIG. 3. The skilled person will appreciate that the plastic outer stud body 34 can be manufactured using techniques such as injection or blow molding, vacuum forming, rotational molding, compression molding, rim molding, power impression molding or any form of plastics manufacture.

The screw studs 22 are at least partly made of conductive material, copper, silver or alloys or mixtures thereof. Alternatively, the stud 22 can be made from other metallic or non-metallic conductive materials such as carbon fiber, which also has the added benefit of being lightweight. The above list is no way intended to be limiting and exhaustive. The fundamental attributes of the stud 22 require that the central shaft 38 to be of an electrically conductive material.

The threaded end 32 forms or defines a low-profile lug 40 or push-fit type connector at the top of the shaft 38. The lug 40 positioned at the threaded end 32 of the shaft 38 projects through a slit or opening 44 formed in the inner sole face 18, as best shown in the enlarged view of FIG. 1. The lug 40 is then connected to one end (42*a*', 42*b*', 42*c*') of a loop (42*a*, 42*b*, 42*c*) of exposed conductive wire 42 which is formed from copper, silver or alloys or mixtures thereof. The electrical connection of the looped wire 42 to the lug 40 of the stud 22 is via a physical spade connection or crimp or by soldering the wire 42 to the lug 40 of the screw stud 22.

The small hole or incision 44 made in the inner sole face 18 adjacent to the molded retaining insert 24, allows the exposed wire 42 to been electrically connected to the ground contacting base 36 of the stud 22, and the wire 42 is then positioned in a generally flat configuration adjacent to the inner sole face 18, as best shown in FIG. 1.

As best shown in FIG. 2, an advantageous grounding effect is achieved when at least six electrically conductive studs 22 are positioned in the sole 14. A pair of studs 22*a* being positioned around the toe portion 30; a pair of studs 22*b* being positioned around the instep portion 28 and a pair of studs 22*c* being positioned around the heel portion 26. Each of these pair of studs 22*a*, 22*b*, 22*c* are electrically connected using looped wires 42*a*, 42*b*, 42*c*, respectively, as described below.

Each of the looped wires 42*a*, 42*b*, 42*c* form ends (42*a*', 42*b*', 42*c*', 42*a*", 42*b*", 42*c*") that are connected to the lugs 40 of the pairs of studs 22*a*, 22*b*, 22*c* secured in the receiving portions 20 as sole structures of the sole 14 and define a stud electrical connection point or "node". The looped wires 42*a*, 42*b*, 42*c* are held in place by a layer of conductive tape or fabric 46, again preferably a copper or silver-based tape or fabric material, as best shown in FIG. 1. In a preferred embodiment, an embossed copper tape, with an acrylic pressure sensitive adhesive and liner, is utilized. The embossing ensuring that an excellent electrical contact is made even through the adhesive.

To provide comfort when in use, an insole 48 is then placed on the top of the layer of conductive tape 46. The insole 48 provides a cushioning layer and which can be formed from a woven fabric material that includes a conductive yarn selected from the group consisting, but not limited to, any one of the following: strands of copper, silver, carbon fiber and combinations thereof. The above list is no way intended to be limiting and exhaustive. The insole 48 also being anatomically shaped to the foot of the user 100 when in use.

As best shown in FIG. 2, each of the pair of studs (a pair of studs being a stud 22*a* as an electrically conductive portion and corresponding stud 22*a* as an adjacent electrically conductive portion, another pair of studs being another stud 22*b*, 22*c* as another electrically conductive portion and corresponding another stud 22*b*, 22*c* as another adjacent electrically conductive portion) is connected by a loop of conductive wire 42*a*, 42*b*, 42*c*, respectively. The conductive wire loops 42*a*, 42*b*, 42*c* are configured to maximize the point of contact with the conductive tape 46 (not shown for clarity reasons in FIG. 2) and are C- or U-shaped. The skilled person will also appreciate that an asymmetrical or other convoluted routes 42*a*" or paths can also be utilized by the conductive wire 42*a*, 42*b*, 42*c* to increase the electrical point of contact.

For performance of the present invention, it is suggested that the individual 100 wear socks 56 that are made from a woven fabric material that includes a conductive yarn selected from the group consisting, but not limited to, any one of the following: strands of copper, silver, carbon fiber and combinations thereof.

The shoe 10 in this exemplary embodiment of the invention is described in relation to a screw studded football shoe, but can be adapted or adopted in any modern sports footwear that includes a screw stud 22 selected from the group consisting, but not limited to, any one of the following: golf shoes, rugby boots, American football boots, hockey shoes, cleats, running spikes etc. The above list is no way intended to be limiting and exhaustive. In order to adapt this technology into other areas of sport or leisure only minor alterations will occur, but these are entirely within the scope of the present invention. Use of the present invention enabling an electrical conduction path to ground to harness the negatively charged electrons and ions carried in the earth and which flow freely from the ground up through the footwear 10, and any sock 56 or foot garment onto the surface of the user's 100 skin.

Use of the screw studded football shoe 10 according to the exemplary embodiment of the invention shown in FIGS. 1 to 3 has been found to significantly reduce the electric field induced voltage on subject's bodies. A simple, but effective, measurement can be made by the use of a digital multimeter. The electric field was firstly measured on a subject's body whilst being in direct contact with grass, and this was found to be around −100 mV. The same subject, using the screw studded footwear 10 as described in relation to FIGS. 1 to 3, was found to have a measured electric field of around −750 mV. Without wishing to be limited by a theory, it is understood that this larger negative potential is indicative of an effective electrical conduction path or contact to ground, and which allows the user 100 to harness or infuse the negatively charged electrons and ions carried in abundance in the earth. These negatively charged electrons and ions flow freely from the ground up through the footwear 10, and any sock 56 or foot garment onto the surface of the user's 100 skin.

Figure 4:
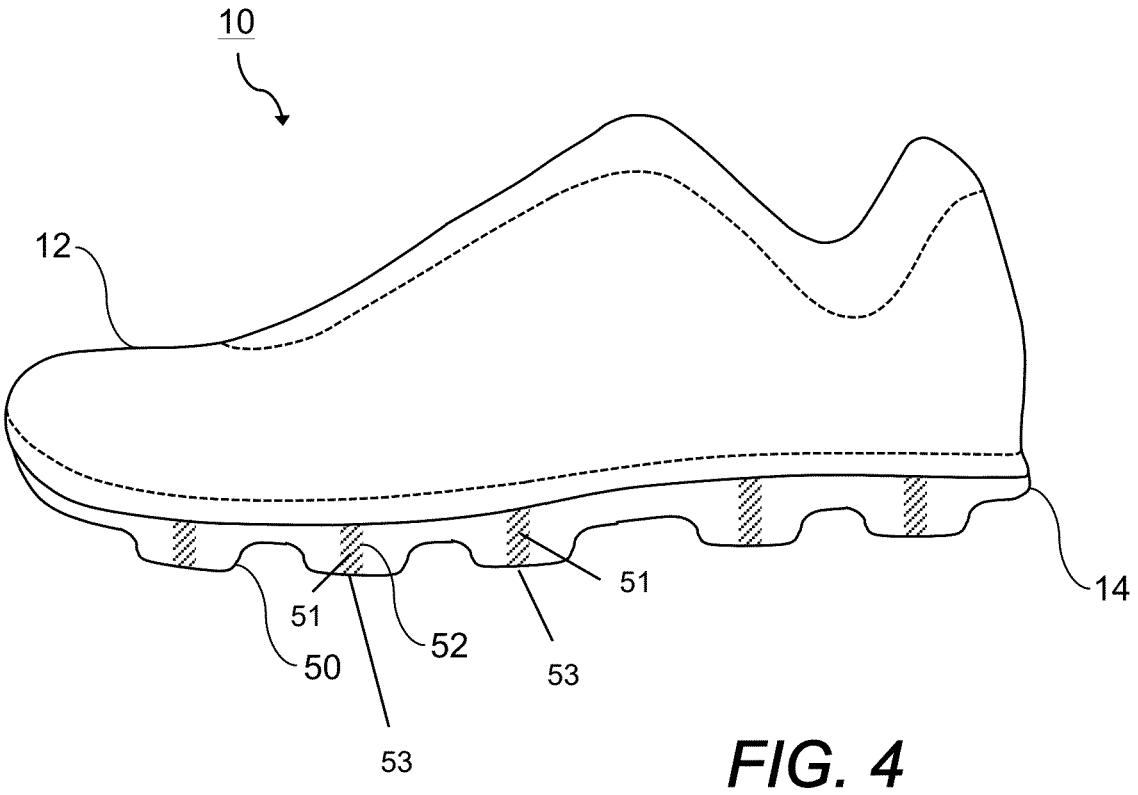
FIG. 4 is a side schematic view of an embodiment of the sole having a bladed portion, according to the present invention.

FIG. 4 shows an alternative embodiment of the shoe 10. The construction of this embodiment is very similar to that of the initial embodiment and corresponding features have been given the same reference numerals. This embodiment differs from the initial embodiment in that, instead of footwear 10 having separate screw studs 22 being inserted in the sole 14, the sole 14 includes a blade portion 50 extending from the outer sole surface 16. The blade portion 50 can be a blade, raised projections, studs, or other protrusion integrally formed with the sole 14. The blade portion 50 has a channel 52, which can also be a portion slit or other cavity. For the blade portion 50, the electrically conductive portion, as an electrically conductive material 51, with a conductive material end 53 extends through the blade portion 50. FIGS. 7-9 show the stud receiving portion through a surrounding projection of the sole around the stud receiving portion, the electrically conductive portion with a shaft extending through the stud receiving portion and the surrounding projection around the stud receiving portion. The electrically conductive portion as screw stud 22 extends from the stud receiving portion 20 through the stud receiving portion and surrounding projection around the stud receiving portion as in FIGS. 7-9. Such a configuration also enables the electrical connection between the ground and insole 48 to occur, as with the embodiment of FIGS. 1 to 3. Such a configuration can also include the slit or opening 44 in the inner sole face 18 for connection to the insole 48.

Figure 5:
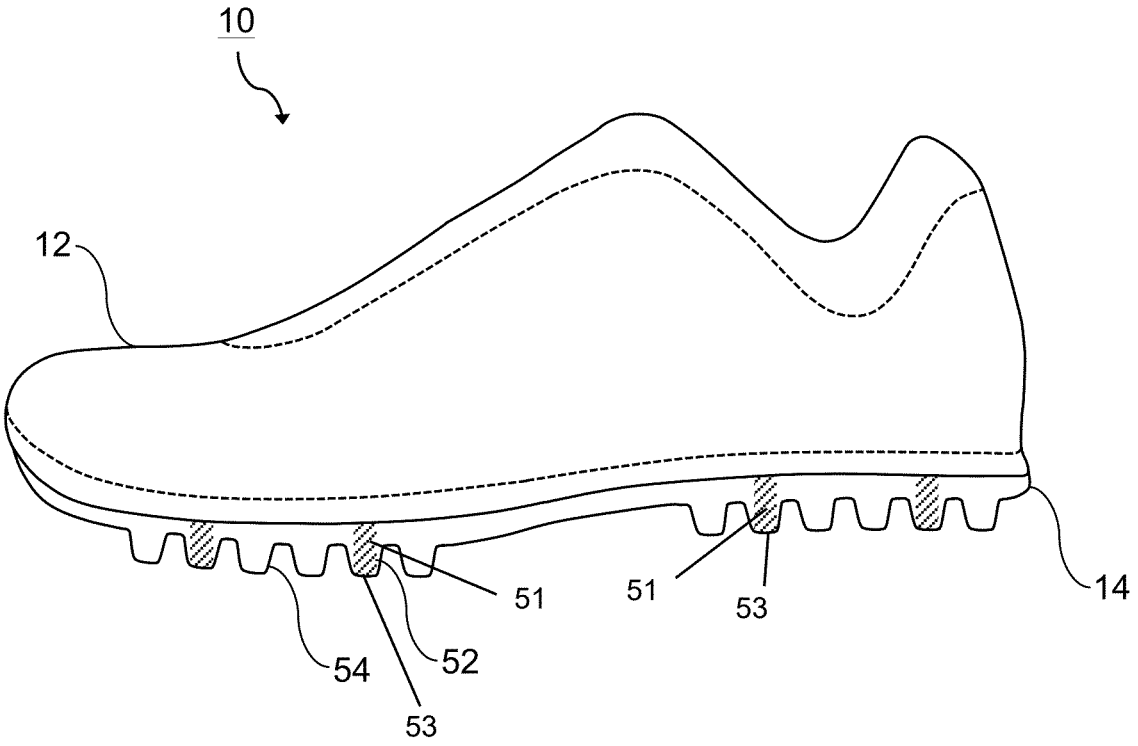
FIG. 5 shows a side schematic view of another embodiment of the sole having another bladed portion, according to the present invention.

There is electrical conduction through the blade portion 50 in FIGS. 4-5. The blade portion 50 is comprised of the same material of the sole 14 and molded integral with the outer sole face 16. The blade portion 50 can be a blade projection across the outer sole face. There can be blade projections with the channel 52 or filled blade projections 54 without the channel. The blade portion 50 can be any raised projection, such as triangular protrusion or round protrusion. There can be raised projections with the channel 52 or filled raised projections without the channel. The piece of conductive material 51 has a conductive material end 53 as the embodiment of the electrically conductive portion. There is electrical conduction through the stud receiving portion and the surrounding projection of the sole around the stud receiving portion in FIGS. 7-9. The electrically conductive portion with a shaft extends through the stud receiving portion and the surrounding projection around the stud receiving portion.

The present invention can work within many different types of sports and leisure footwear. For example, FIGS. 5 and 8 show how the present invention can be configured as a tennis or golf shoe 10. Very much like FIGS. 4 and 7, the electrically conductive portions as screw studs 22 would be inserted directly into the sole 14 of the shoe 10 through the stud receiving portion 20 and the stud receiving portion with the surrounding projection of the sole around the stud receiving portion, and the same looped wires 42 of FIG. 2 (not shown in FIGS. 5 and 8 for clarity reasons) would connect to the ground contacting base 36 of the screw stud 22 to the inner sole face 18.

Figure 6:
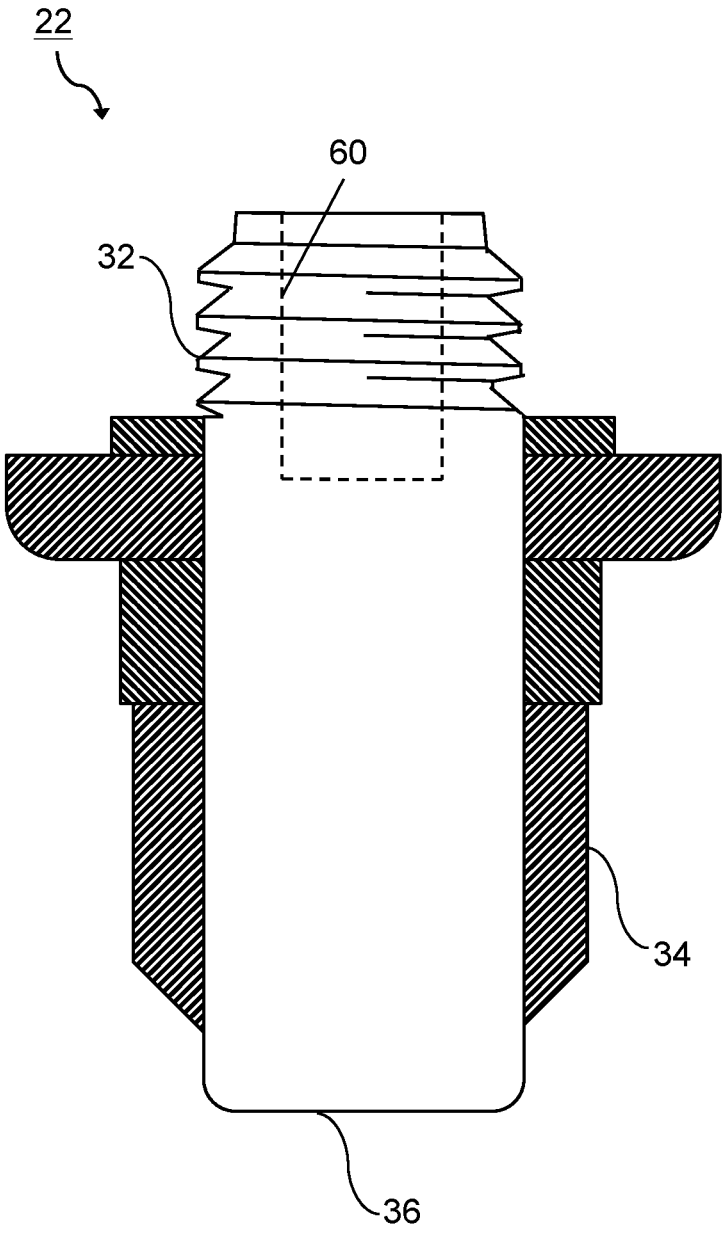
FIG. 6 illustrates a cross-sectional view of an embodiment of the screw stud, according to the present invention.

FIG. 6 shows a third embodiment of a screw stud 22 for use with footwear 10. The construction of the third embodiment is very similar to that of the first and second embodiments and corresponding features have been given the same reference numerals. The third embodiment differs from the first and second embodiments in that instead of a low-profile lug 40 extending from the threaded end 32 at the top of the shaft 38, the shaft 38 of the screw stud 22 features a blind hole 60. The blind hole 60 is disposed at the top of the shaft 38 enabling the electrical connection of the looped wire 42 to the stud 22 usually by way of soldering the wire 42 (not shown) inside the blind hole 60. This is a simple and effective way of connecting the wire loop 42 to the stud 22.

The shoe 10 of the present invention is considered particularly beneficial for sportspersons who are prone to injury or who suffer from reoccurring chronic conditions. What is apparent is that with all embodiments of the invention is that the conductive shaft 38 formed in the outwardly projecting screw studs 22 with a body portion 34 for the shaft 38 allows any extraneous static electricity, positive ions and other electromagnetic fields and charges that are otherwise present in the individual 100 to be naturally dissipated to the ground when that person in engaged in sports or leisure activities. Even through a blade portion 50 on the outer sole face 16, the electrically conductive portion dissipates to the ground.

The skilled person will understand that the present invention could also be configured such that the material forming the upper portion 12 of the shoe 10 is also made from a conductive fabric material, as described above in relation to the insole 48. The upper portion 12 covers the foot of the user.

A soluble coating 12A which could incorporate a conductive compound, such as silver ion solution in its composition, could also be applied to the outer layer of the shoe 10, the upper portion 12, and the sole 14 to create a waterproof and conductive coating which enhances the grounding effects described herein.

The skilled person will understand that aspects of the invention, and particularly the features of the looped wire 42 in contact with, or sandwiched between layers of conductive tape 46, adjacent to one or more layers of conductive woven fabric material 48A of an insole 48 could be isolated from the footwear 10, and instead embodied as an electrically grounded conductive mat or pad. The mat or pad could be connected to a separate ground connection or rod via a grounding wire connection for use in indoor sports activities, such as in a gym, or for post-exercise sports treatment and rehabilitation, as part of a massage table.

Preliminary studies of professional footballers using thermal imaging analysis has revealed that use of the present invention, even over short periods of time, markedly improves blood and lymphatic circulation which, in turn, reduces pain and inflammation and aids recovery.

The invention is not intended to be limited to the details of the embodiments described herein, which are described by way of example only. Various additions and alternations may be made to the present invention without departing from the scope of the invention. For example, although particular embodiments refer to implementing the present invention with football shoes or boots, this is in no way intended to be limiting as, in use, the present invention can be applied to any type of footwear. It will be understood that features described in relation to any particular embodiment can be featured in combination with other embodiments.

We claim:

1. An article of footwear for grounding a human body to earth, comprising:

an upper portion;

a sole having an outer sole face distal to said upper portion and an inner sole face proximate to said upper portion;

an electrically conductive portion extending through said sole from said outer sole face toward said inner sole face;

an electrically conductive layer extending over a portion of said inner sole face; and a conductive wire having one wire end connected to said piece of conductive material so as to form at least one electrical connection of a group consisting of: a physical spade connection, a crimp connection, and a soldered connection, wherein said sole comprises a blade portion, said blade portion extending from said outer sole face, and wherein said electrically conductive portion is comprised of a piece of conductive material having a conductive material end outwardly projecting from said outer sole face so as to form an electrical conduction path to ground relationship from said inner sole face to an outermost part of said blade portion through said piece of conductive material.

2. The article of footwear, as in claim 1, wherein said blade portion is comprised of a material of said sole and molded integral with said outer sole face.

3. The article of footwear, as in claim 1, wherein said blade portion comprises a channel through said blade portion.

4. The article of footwear, as in claim 1, wherein said blade portion is a blade projection.

5. The article of footwear, as in claim 1, wherein said blade portion is a raised projection.

6. The article of footwear, as in claim 1, wherein said electrically conductive layer comprises a layer of conductive tape, the article further comprising:

an insole being positioned above said layer of conductive tape and being comprised of a cushioning layer formed from a woven fabric material, said woven fabric material being comprised of a conductive yarn.

7. The article of footwear, as in claim 1, further comprising:

a soluble coating being applied to said upper portion and said sole, said soluble coating being comprised of a conductive compound.

8. The article of footwear, as claim 1, further comprising:

an adjacent electrically conductive portion extending through said sole from said outer sole face toward said inner sole face and through said blade portion, wherein said conductive wire has another wire end connected to said adjacent electrically conductive portion so as to form a loop.

9. The article of footwear, as in claim 8, wherein said loop is positioned in a flat configuration aligned with said inner sole face.

10. The article of footwear, as in claim 8, wherein said loop has a convoluted path.

11. The article of footwear, as in claim 8, further comprising:

another electrically conductive portion extending through said sole from said outer sole face toward said inner sole face and through another blade portion; and another adjacent electrically conductive portion extending through said sole from said outer sole face toward said inner sole face and through said another blade portion so as to form another loop between said another electrically conductive portion and said another adjacent conductive portion, wherein said loop and said another loop are positioned adjacent to said inner sole face.

12. The article of footwear, as in claim 11, wherein said sole is comprised of a heel portion, and an instep portion, said loop being in said heel portion, said another loop being in said instep portion.

* * * * *